US011814787B2

(12) United States Patent
Fu et al.

(10) Patent No.: US 11,814,787 B2
(45) Date of Patent: Nov. 14, 2023

(54) METHOD FOR MANUFACTURING INTELLIGENT DESIGNED DIGITAL PRINTING FABRIC WITH ENERGY SAVING EFFECT

(71) Applicant: ZHEJIANG FURUN DYEING AND PRINTING CO., LTD., Shaoxing (CN)

(72) Inventors: Guo Zhu Fu, Zhejiang (CN); Yi Feng Wang, Shaoxing (CN); Ke Zhou, Shaoxing (CN)

(73) Assignee: ZHEJIANG FURUN DYEING AND PRINTING CO., LTD., Zhuji (CN)

( * ) Notice: Subject to any disclaimer, the term of this patent is extended or adjusted under 35 U.S.C. 154(b) by 90 days.

(21) Appl. No.: 17/603,414

(22) PCT Filed: Feb. 5, 2021

(86) PCT No.: PCT/CN2021/075495

§ 371 (c)(1),
(2) Date: Oct. 13, 2021

(87) PCT Pub. No.: WO2022/147879

PCT Pub. Date: Jul. 14, 2022

(65) Prior Publication Data

US 2023/0135741 A1 May 4, 2023

(30) Foreign Application Priority Data

Jan. 6, 2021 (CN) ..... 202110012045.0

(51) Int. Cl.

| | |
|---|---|
| ***D06P 5/30*** | (2006.01) |
| ***D06P 1/44*** | (2006.01) |
| ***D06P 1/48*** | (2006.01) |
| ***D06P 1/649*** | (2006.01) |
| ***D06P 1/673*** | (2006.01) |
| ***D06P 5/20*** | (2006.01) |

(52) U.S. Cl.

CPC ..... *D06P 5/30* (2013.01); *D06P 1/445* (2013.01); *D06P 1/48* (2013.01); *D06P 1/6491* (2013.01); *D06P 1/6735* (2013.01); *D06P 5/2077* (2013.01); *D10B 2201/02* (2013.01); *D10B 2201/10* (2013.01)

(58) Field of Classification Search

CPC ..... D06P 5/30; D06P 5/2077; D06P 1/445; D06P 1/48; D06P 1/6941; D06P 1/6735; D10B 2201/02; D10B 2201/10

See application file for complete search history.

(56) References Cited

FOREIGN PATENT DOCUMENTS

| | | | | |
|---|---|---|---|---|
| CN | 205223616 U | | 5/2016 | |
| CN | 107761411 A | | 3/2018 | |
| CN | 208881380 U | | 5/2019 | |
| CN | 210283643 U | | 4/2020 | |
| WO | WO2014071678 | * | 5/2014 | ..... D06B 7/04 |

* cited by examiner

*Primary Examiner* — Amina S Khan

(57) ABSTRACT

A method for manufacturing a fabric with an intelligently-designed digitally-printed pattern with energy saving effect is disclosed. It includes S1: knitting a cotton yarn, a bamboo fiber yarn, and a mulberry silk yarn into a silk-cotton plain knitted single-sided fabric; S2: subjecting the fabric to a double-sided singeing; S3: mercerizing the fabric obtained in step S2; S4: subjecting the mercerized fabric to a neutralizing processing, a bleaching processing, a deoxidating processing, and a whitening processing in sequence; S5: setting the base color of the fabric obtained in step S4; S6: subjecting the fabric obtained in step S5 to a sizing and setting treatment, a pattern design treatment, a digital printing, a steaming treatment, and a water washing treatment; S7: subjecting the fabric obtained in step S6 to a soft setting; S8: subjecting the fabric obtained in step S7 to a decating treatment; and S9: pre-shrinking the fabric obtained in S8.

8 Claims, 6 Drawing Sheets

METHOD FOR MANUFACTURING INTELLIGENT DESIGNED DIGITAL PRINTING FABRIC WITH ENERGY SAVING EFFECT

CROSS REFERENCE TO RELATED APPLICATION

This application claims the priority of Chinese Patent Application No. 202110012045.0, entitled "Method for manufacturing a fabric with an intelligently-designed digitally-printed pattern with energy saving effect" filed with the Chinese National Intellectual Property Administration on Jan. 6, 2021 which is incorporated herein by reference in its entirety.

TECHNICAL FIELD

The present disclosure relates to the technical field of fabric, and specifically to a method for manufacturing a fabric with an intelligently-designed digitally-printed pattern with energy saving effect.

BACKGROUND ART

Currently, the digital printing presents a trend that the printing speed of equipment is becoming faster, the cost of nozzles is becoming lower, the application mode is well-development, and the automation stability of equipment is getting better. Driven by the application of digitization and automation and big data, there is a trend that screen printing would be replaced by digital printing among traditional printing and dyeing enterprises. Many printing and dyeing enterprises, more or less, have bought digital printing and dyeing devices. However, the informatization level of the production line is not high. The future development trend of digital ink-jet printing industry in China is that the equipment and technology will be further improved, the cost will be further reduced, and the market will be further expanded.

The integration of manufacturing industry and the Internet is in line with the national industrial policy. It is a project encouraged by the government aiming to establish a hardware development and manufacturing system of the whole industrial chain, that is, a manufacturing system centering on small and medium batch orders involving design and development, digital printing, and clothing style design and manufacture. In this system, the service process, manufacturing process, and delivery process are informationized and networked. Artificial intelligence pattern design and design tools are provided, and a new type of sale and new design are formed, which could create a convenient website platform for enterprises to complete product development and manufacturing, processing and delivery and other services online.

For example, the tie-dyed fabric have been widely used in fashion clothing because of its unique visual image, unfamiliar texture effect and in-depth interpretation of popular art. Traditional tie-dyed fabric was obtained by hand wrapping and dip dyeing, which needed a lot of manpower and caused serious pollution to the environment. Therefore, the process is not conducive to the current mainstream fast fashion green printing and dyeing.

SUMMARY

An object of the present disclosure is to provide a method for manufacturing a fabric with an intelligently-designed digitally-printed pattern with energy saving effect, which could solve the above technical problems.

In order to achieve the above object, the present disclosure provides the following technical solutions. The method for manufacturing the fabric with an intelligently-designed digitally-printed pattern with energy saving effect includes S1. knitting: knitting a cotton yarn, a bamboo fiber yarn, and a mulberry silk yarn into a silk-cotton plain knitted single-sided fabric;

S2. singeing: subjecting the silk-cotton plain knitted single-sided fabric to a double-sided singeing, to obtain a fabric after the singeing;

S3. mercerizing: mercerizing the fabric after the singeing by utilizing a knitting mercerizing machine to obtain a mercerized fabric;

S4. boiling: subjecting the mercerized fabric to a neutralizing processing, a bleaching processing, a deoxidating processing, and a whitening processing in sequence to obtain a boiled-out fabric;

S5. setting a base color: setting the base color of the boiled-out fabric to obtain a base colored fabric;

S6. printing: subjecting the colored fabric to a sizing and setting treatment, a pattern design treatment, a digital printing, a steaming treatment, and a water washing treatment, to obtain a printed fabric, wherein the digital printing is performed by utilizing a the digital printing and drying partition processing apparatus, and the digital printing comprises performing an ink-jet printing on the pattern-designed fabric by a digital ink-jet printing system of the digital printing and drying partition processing apparatus; after the ink-jet printing, passing the ink-jet printed fabric into a drying zone and drying therein; the digital ink-jet printing system and the drying zone are continuously arranged; the digital ink-jet printing system and the drying zone are arranged in different spaces;

the digital printing and drying partition processing apparatus comprises a fixed bottom plate;

a clamping traction component;

a conveying component;

two support plates, which are vertical and symmetrically provided at the top of the fixed bottom plate (1);

a first conveyor belt and a second conveyor belt, which are arranged between the two support plates at intervals;

a printing machine, a first dryer, a steamer, and a second dryer, which are arranged in sequence at the top of the two support plates at intervals, wherein the printing machine and the first dryer are engaged with the first conveyor belt, and the steamer and the second dryer are engaged with the second conveyor belt; the clamping traction component is provided at one side of one of the two support plates, and an output end of the clamping traction component penetrates through one of the two support plates and extends between the two support plates; the conveying component is provided between the two support plates;

a U-shaped frame, which is arranged at an upper side of one of the two support plates through a hinge point, and one end of the U-shaped frame far away from the one of the two support plates is provided with a V-shaped opening; the U-shaped frame rotates around the hinge point such that the V-shaped opening is stuck on the uppermost side of the other of the two support plates;

a rolling curtain, which is connected to the U-shaped frame and positioned between the printing machine and the first dryer, wherein after unwinding the rolling curtain, a gap is left between a lower side of the rolling curtain and a upper conveying surface of the first conveyor belt.

S7. soft setting: subjecting the printed fabric to a soft setting by utilizing a setting machine to obtain a soft set fabric;

S8. decating treatment: subjecting the soft set fabric to a decating treatment under a condition of damp heat and relaxation, to eliminate a residual internal stress to obtain a fabric after the decating treatment; and S9. pre-shrinking treatment: pre-shrinking the fabric after the decating treatment by utilizing a pre-shrinking machine to make a size change rate of water washing not more than 3%, to obtain the fabric with an intelligently-designed digitally-printed pattern.

According to the above method for manufacturing the fabric with an intelligently-designed digitally-printed pattern with energy saving effect, in some embodiments, in step S1, the cotton is a long staple cotton, and 46% of a 65 S long staple cotton, 42% of the bamboo fiber yarn, and 12% of the mulberry silk yarn are combined to form the double strand yarn;

the knitting is performed by utilizing a Chinese Taiwan single-sided great circle machine, with knitting parameters: a machine number of 32 needles/25.4 mm, a cylinder diameter of 34 inches, and a fabric width of 160 cm.

According to the above method for manufacturing the fabric with an intelligently-designed digitally-printed pattern with energy saving effect, in step S2, the singeing is performed with parameters: a burner pressure of 1.5-1.7 Pa and a singeing speed of 54-56 m/min, and the singeing should be uniform to prevent uneven singeing.

According to the above method for manufacturing the fabric with an intelligently-designed digitally-printed pattern with energy saving effect, in some embodiments, in step S3, the mercerizing is performed with parameters: an alkali resistant penetrating agent-1005 with a concentration of 7.8-8.3 g/L, a roll alkali with a concentration of 183-187 g/L, a speed of 18 m/min, an unloading weight of 135 g, an overfeed of 12/0/0%, and an unloading width of 140 cm.

According to the above method for manufacturing the fabric with an intelligently-designed digitally-printed pattern with energy saving effect, in some embodiments, in step S4, the neutralizing processing is performed by using 2 g/L oxalic acid; the bleaching treatment includes step A: introducing the fabric into a hot water with a temperature of 40° C., adding hydrogen peroxide stabilizer 1003 and an iron ion chelating dispersant and operating for 2 minutes, adding an alkali and operating for 2 minutes, and adding hydrogen peroxide and operating for 2 minutes;

step B: heating to 70° C., and adding a refining agent 3001;

step C: heating to 98° C., maintaining the temperature for 40 minutes, then cooling to 78° C. and cutting a sample, finally heating to 80° C. and washing by overflowing water for 10 minutes, measuring a pH value of a drainage at an outlet, and draining and discharging the fabric;

the deoxidating processing comprises using a high-efficiency deoxyenzyme with a temperature of 45° C.;

the whitening processing includes feeding the fabric into water, adding an acid thereto, heating the resulting mixture to 40° C., adding 0.6% of 4BK-S whitening agent and 0.1% of 777 fluorescent whitening agent thereto, heating the resulting mixture to 90° C., operating for 20 minutes, whitening a base fabric, cooling the resulting system to 78° C. and cutting a sample, feeding water, washing by overflowing water for 5 minutes, and draining and discharging the fabric; and the bleaching is performed with a bleach; the bleach includes hydrogen peroxide with a concentration of 7.8-8.3 g/L, a refining agent with a concentration of 1 g/L, caustic soda with a concentration of 2.5 g/L, a hydrogen peroxide stabilizer with a concentration of 0.4-0.6 g/L, and an iron ion chelating dispersant with a concentration of 1.2 g/L.

According to the above method for manufacturing the fabric with an intelligently-designed digitally-printed pattern with energy saving effect, in some embodiments, in step S5, the setting is performed with parameters: a temperature of 140° C., a speed of 50 m/min, an air volume of 1500 r/min, a pressure of 5 kgf/cm$^2$, an overfeed of 8/0/0%, a width of 153 cm, and a weight per unit area of 140 g/m2.

According to the above method for manufacturing the fabric with an intelligently-designed digitally-printed pattern with energy saving effect, in some embodiments, in step S6, the sizing and setting treatment is performed by an impregnation to make the fabric coated with a sizing agent, and the sizing agent includes, in parts by weight, 490-510 g of a self-preparation chemical synthesis paste, 30 g of sodium bicarbonate, 10 g of a colorless anti-staining, 30 g of sodium sulfate, 70 g of urea, 30 g of 373 hygroscopic agent, and 320-340 g of water. In some embodiments, the impregnation is performed with parameters: a rolling pressure determination of 3 kgf/cm$^2$, an air volume of 1260 r/min, a temperature of 110° C., a speed of 40 m/min, a pick-up rate of 85%, and an overfeeding of 0/0/0%.

In some embodiments, the self-preparation chemical synthesis paste is prepared from 4-6 kg of a chemical synthesis paste, 0.8-1.2 kg of seaweed, and 93-98 kg of water.

In some embodiments, the pattern design treatment is performed by utilizing an AI intelligent pattern design platform.

In some embodiments, the drying zone adopts an electric heating drying, and a temperature in the drying room is in the range of 80-90° C.

In some embodiments, the steaming treatment is performed by utilizing a mist type humidifier to spray moisture and regain moisture at a speed of 20 m/min, to humidify sufficiently and homogeneously; due to the fine pattern, the printed fabric needs to be steamed immediately after regaining moisture; the steaming is performed with parameters: a ring length of 2.3 m, a temperature of 105° C., a time of 10 min, a speed of 26 m/min, and a steam flow of 900 kg/h.

In some embodiments, the water washing treatment is performed by utilizing a continuous rope-shaped water washing machine at a speed of 35 m/min, and comprises procedures of dehydrating through a padder after rinsing with water in a first cylinder and a second cylinder; washing in a third cylinder, a fourth cylinder, a fifth cylinder and a sixth cylinder, which are configured to contain water with a temperature of 90° C. and a soaping agent with a concentration of 4 g/L; cleaning with water in a seventh cylinder and an eighth cylinder; dehydrating and scutching.

In some embodiments, the clamping traction component includes a first traction assembly and a second traction assembly, and the first traction assembly includes a first motor, an air cylinder, a first fixed block, a second fixed block, a clamping pillar, a spring, a first limit block, and a first rotating roller. In some embodiments, the first fixed block is concave shaped and is arranged on one side of one of the two support plates. In some embodiments, the air cylinder is arranged on one side of the first fixed block, and an output end of the air cylinder penetrates the first fixed block and is fixedly connected with the second fixed block. In some embodiments, the first motor is arranged on one side of the second fixed block, and an output end of the first motor penetrates through one of the two support plates and extends between the two support plates. In some embodiments, the clamping pillar is inserted on one side of the other of the two support plates, and one end of the clamping pillar penetrates through the support plates and extends and In some embodiments, and the other end of the clamping pillar is provided with the first limit block. In some embodiments, the spring is sheathed on the clamping pillar, and both ends of the spring are fixedly connected with the first limit block and one of the two support plates respectively. In some embodiments, the first rotating roller is rotationally arranged between the clamping pillar and the output end of the first motor. In some embodiments, the second traction assembly includes a second motor and a second rotating roller. In some embodiments, the second motor is arranged on one side of one of the support plates. In some embodiments, an output end of the second motor penetrates through one of the two support plates and is rotationally connected with one end of the second rotating roller. In some embodiments, the other end of the second rotating roller is rotationally connected with the other of the two support plates.

According to the above method for manufacturing the fabric with an intelligently-designed digitally-printed pattern with energy saving effect, in step S7, the soft setting is performed by utilizing a Monforts Fong's setting machine.

According to the above method for manufacturing the fabric with an intelligently-designed digitally-printed pattern with energy saving effect, in some embodiments, in step S8, the decating is performed at a speed of 20 meters and a temperature of 130° C.

According to the above method for manufacturing the fabric with an intelligently-designed digitally-printed pattern with energy saving effect, in some embodiments, in step S9, the pre-shrinking treatment is performed by utilizing an Italy SANTEX pre-shrinking machine, and the pre-shrinking is performed with parameters: a temperature of 135° C., a speed of 28 m/min, a feeding fabric speed ratio of 1%, an unloading blanket speed ratio of 5%, and a cooling belt speed ratio of 1%.

Compared with the existing technology, the method for manufacturing the fabric with an intelligently-designed digitally-printed pattern with energy saving effect has the following advantages. Cotton yarn, bamboo fiber yarn, and mulberry silk yarn are blended and knitted. Artificial intelligence design pattern is printed by a digital ink-jet printing. The intelligent color management system and printing system are designed to be digital, intelligent and networked, realizing intelligent color matching and proofing, and one button fitting three-dimensional simulation display. The introduction of artificial intelligence pattern design and digital printing keep up with the fashion trend, increasing its artistry. The prepared product is smooth, comfortable, and breathable, feels cool when it contacts the skin, and exhibits natural antibacterial, bacteriostatic and anti-ultraviolet properties. It is thus the first choice of fabrics to make summer clothing for upscale brands. Meanwhile, the manufacturing process is energy saving, and realizes the clean production.

The drying system and printing system are separated into two rooms. The water vapor and heat after drying are recovered through the water vapor and waste heat removal channels in the drying zone. In this way, the rise of temperature in the printing zone could be effectively controlled, preventing the nozzle blockage, reducing the air conditioner burden, thereby greatly reducing the power consumption, and reducing energy consumption.

DETAILED DESCRIPTION OF THE EMBODIMENTS

The following are the specific embodiments of the present disclosure, and the technical solution of the present disclosure is further described in combination with the drawings, but the present disclosure is not limited to these embodiments.

Example 1

The method for manufacturing the fabric with an intelligently-designed digitally-printed pattern with energy saving effect was performed as follows:

S1. knitting: a 65 S cotton yarn, a bamboo fiber yarn, and a mulberry silk yarn were combined to form a double strand yarn, and then the double strand yarn was knitted into a silk-cotton plain knitted single-sided fabric. The cotton yarn used was a combed long staple cotton yarn, and 46% of the long staple cotton yarn, 42% of the bamboo fiber yarn, and 12% of the mulberry silk yarn were combined to form the double strand yarn. The knitting was performed by utilizing a Chinese Taiwan single-sided great circle machine, with knitting parameters: a machine number of 32 needles/25.4 mm, a cylinder diameter of 34 inches, and a fabric width of 160 cm.

Compared with the ordinary cotton yarn, the combed cotton yarn is smoother, and flatter. The bamboo fiber has good moisture absorption and air permeability, strong wear resistance, and natural antibacterial, bacteriostasis, mite killing, deodorization, and ultraviolet resistance functions. The addition of mulberry silk yarn makes the fabric feel more soft, smooth, cool when it contacts with the skin, and more comfortable and breathable.

Further, in this example, 70S single strand long staple cotton yarn, 60D bamboo fiber yarn, and 120D mulberry silk yarn were selected and were combined to form a 65S double strand yarn.

In order to further improve the fabric texture, the long staple cotton yarn was singed and mercerized in the early stage.

S2. singeing: the fabric obtained in step S1 was subjected to a double-sided singeing.

Specifically, the singeing was performed with parameters: a burner pressure of 1.6 Pa and a singeing speed of 55 m/min. The singeing were uniform to prevent uneven singeing.

S3. mercerizing: the fabric obtained in step S2 was mercerized by utilizing a knitting mercerizing machine.

Specifically, the mercerizing was performed with parameters: an alkali resistant penetrating agent-1005 with a concentration of 8 g/L, a roll alkali with a concentration of 185 g/L, a speed of 18 m/min, an unloading weight of 135 g, an overfeed of 12%, and an unloading width of 140 cm.

Good dimensional stability, strength, elongation, and surface gloss could be obtained after the mercerizing.

S4. boiling: the mercerized fabric in step S3 was subjected to a neutralizing processing, a bleaching processing, a deoxidating processing, and a whitening processing in sequence, obtaining a boiled-out fabric.

Figure 1:
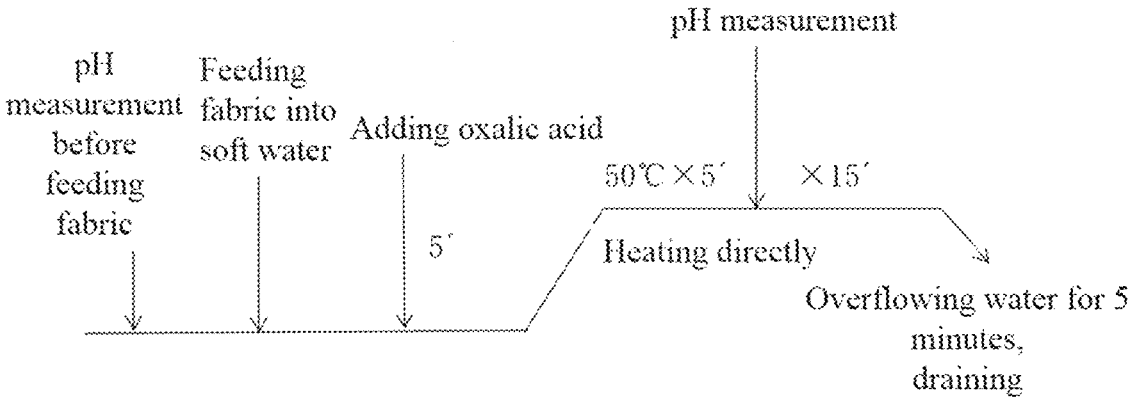
FIG. 1 shows the process curve diagram of the neutralizing processing according to the present disclosure.

The neutralizing processing was performed by using 2 g/L oxalic acid, and the process curve of the neutralizing processing was shown in FIG. 1.

The bleaching was performed by using a bleach, which consisted of hydrogen peroxide with a concentration of 8 g/L, a refining agent 3001 with a concentration of 1 g/L, caustic soda with a concentration of 2.5 g/L, 1003 hydrogen peroxide stabilizer with a concentration of 0.5 g/L, and an iron ion chelating dispersant with a concentration of 1.2 g/L.

Figure 2:
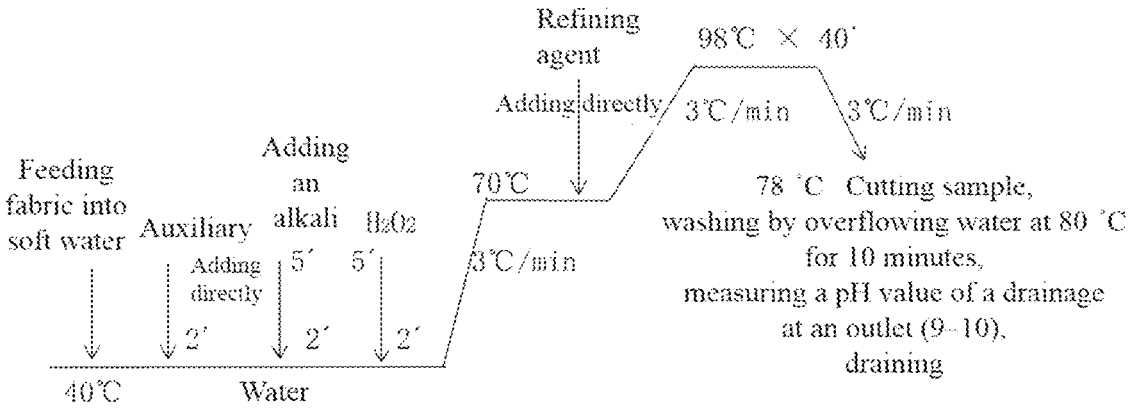
FIG. 2 shows the process curve diagram of the bleaching process according to the present disclosure.

Specifically, FIG. 2 shows the curve diagram of the bleaching process. The procedures of the bleaching treatment were as follows:

Step A: A hot water with a temperature of 40° C. was fed, 1003 hydrogen peroxide stabilizer, and an iron ion chelating dispersant were added and the system was held for 2 minutes. An alkali was then added thereto, and the system was held for 2 minutes. Hydrogen peroxide was then added and the system was operated for 2 minutes.

Step B: The system was heated to 70° C. Refining agent 3001 was then added thereto.

Step C: The system was heated to 98° C., maintained at the temperature, and operated for 40 minutes. The system was then cooled to 78° C. and the fabric was cut for a sample. The system was finally heated to 80° C. and washed by overflowing water for 10 minutes. The pH value of the drainage at the drainage outlet was measured, and the drainage and the fabric were discharged.

The bleaching makes the fabric smooth and clear, and uniform in whiteness.

Further, the capillary effect should be more than 10 cm/30 min to ensure the full reaction between fiber and dye to enhance the coloration.

After the bleaching, there was hydrogen peroxide residue on the yarn, which needs to be neutralized to remove the residual hydrogen peroxide on the fabric to prevent the generation of dyeing defect. Therefore, the deoxidating treatment was adopted. The deoxidating treatment was performed by using a high-efficiency deoxyenzyme at a temperature of 45° C., and the amount of the high-efficiency deoxyenzyme was 0.1 g/L.

Figure 3:
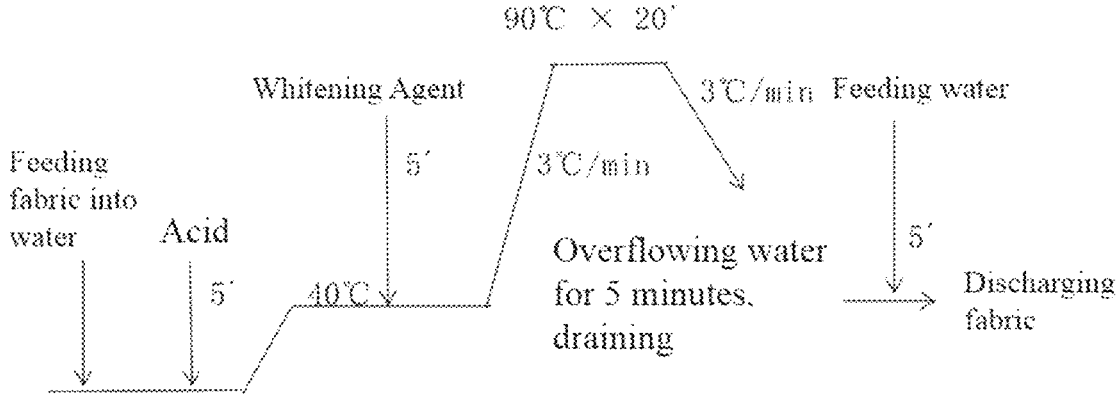
FIG. 3 shows the process curve diagram of the whitening process according to the present disclosure.

FIG. 3 shows the curve diagram of the whitening treatment process. The whitening processing was performed as follows: the fabric was fed into water. An acid was added thereto, and the system was heated to 40° C. 0.6% of 4BK-S whitening agent and 0.1% of 777 fluorescent whitening agent were added thereto. The system was heated to 90° C., and operated for 20 minutes. The base fabric was whitened. The system was cooled to 78° C. and cut for a sample. Water was fed, and the fabric was washed by overflowing water for 5 minutes. The drainage and the fabric were discharged.

S5. setting a base color: the fabric obtained in step S4 was set a base color.

In order to make the printing size stable, the fabric surface flat, the printing pattern bright, and the weight and width meet the requirements, a Monforts Fong's setting machine was selected for the setting of the base color to ensure the weight and size stability. The base color was set with parameters: a temperature of 140° C., and a speed of 50 m/min, an air volume of 1500 r/min, a pressure of 5 kgf/cm$^2$, an overfeed of 8/0/0%, a width of 153 cm, and a weight unit area of 140 g/m2.

S6. printing: The fabric processed in step S5 was subjected to a sizing and setting treatment, a pattern design treatment, a digital printing, a steaming treatment, and a water washing treatment, to obtain a printed fabric.

The digital printing was performed by utilizing a digital printing and drying partition processing apparatus. An ink-jet printing was performed on the pattern-designed fabric by a digital ink-jet printing system of the digital printing and drying partition processing apparatus. After the ink-jet printing, the jet-printed fabric was passed into a drying zone and dried therein. The digital ink-jet printing system and the drying zone were continuously arranged, and the digital ink-jet printing system and the drying zone were arranged in different spaces. Further, there was a connecting channel between the two spaces to facilitate the fabric to pass through.

Specifically, the sizing and setting treatment was performed by an impregnation to make the fabric coated with a sizing agent. In order to improve the printing uniformity, color stability, color development, and good printing effect of full bottom printing, many comparative tests and demonstrations had been carried out, and showed that the sizing agent consisted of 500 g of a self-preparation chemical synthesis paste, 30 g of sodium bicarbonate, 10 g of a colorless anti-staining salt, 30 g of sodium sulfate, 70 g of urea, 30 g of 373 hygroscopic agent, and 330 g of water.

The impregnation was performed with parameters: a rolling pressure determination of 3 kgf/cm$^2$, an air volume of 1260 r/min, a temperature of 110° C., a speed of 40 m/min, a pick-up rate of 85%, and an overfeeding of 0/0/0%.

In order to ensure bright color, deep color and good fabric permeability, after many tests, the formula of the original paste was as follows. The self-preparation chemical synthesis paste was prepared from 5 kg chemical synthesis paste, 1 kg seaweed, and 95 kg water. Preferably, the paste needs to be puffed evenly, and leaving to stand overnight was to improve the expansion degree. Fabric sizing was to avoid the spread of the printed pattern, thereby achieving bright color, and high color yield. The self-preparation chemical synthesis paste was used to impart good color yield and outline clarity to the printed fabric. Further, it was soluble in water and exhibits good paste removal property, imparting soft hand feel to the printed fabric. Meanwhile, its addition leads to a slight increase in the viscosity of pad dyeing solution, thereby being more stable. The combination with sodium alginate has good water retention property, which was conducive to the adhesion of dye to the fiber. However, if its amount was too large, the coating is thicker, and it would hinder the dyeing of the fiber.

After the fabric was finally set, it was rolled immediately and sealed with plastic paper.

Specifically, as shown in FIGS. 5 to 11, the digital printing and drying partition processing apparatus included a fixed bottom plate 1, a clamping traction component 2, and a conveying component 3; two support plates 4, which were vertical and symmetrically provided at the top of the fixed bottom plate 1; a first conveyor belt 5 and a second conveyor belt 6, which were arranged between the two support plates 4; a printing machine 7, a first dryer 8, a steamer 9 and a second dryer 10, which were arranged in sequence at the top of the two support plates 4 at intervals, wherein the printing machine 7 and the first dryer 8 were engaged with the first conveyor belt 5, and the steamer 9 and the second dryer 10 were engaged with the second conveyor belt 6; the clamping traction component 2 was arranged at one side of one of the two support plates 4, and an output end of the clamping traction component 2 penetrates through one of the two support plates 4 and extends between the two support plates 4; the conveying component 3 was arranged between the two support plates 4.

Specifically, the clamping traction component 2 included a first traction assembly 21 and a second traction assembly 22. The first traction assembly 21 included a first motor 211, an air cylinder 212, a first fixed block 213, a second fixed block 214, a clamping pillar 215, a spring 216, a first limit block 217, and a first rotating roller 218. The first fixed block 213 was concave shaped and was arranged on one side of one of the support plates 4. The air cylinder 212 was arranged on one side of the first fixed block 213. An output end of the air cylinder 212 penetrated through the first fixed block 213 and was fixedly connected with the second fixed block 214. The first motor 211 was arranged on one side of the second fixed block 214. An output end of the first motor 211 penetrated through one of the two support plates 4 and extended between the two support plates 4. The clamping pillar 215 was inserted on one side of the other of the two support plates 4, and one end of the clamping pillar 215 penetrated through the support plates 4 and extended. And the first limit block 217 was arranged on the other end of the clamping pillar 215. The spring 216 was sheathed on the clamping pillar 215, and both ends of the spring 216 were fixedly connected with the first limit block 217 and one of the two support plates 4 respectively. The first rotating roller 218 was rotationally arranged between the clamping pillar 215 and the output end of the first motor 211. The second traction assembly 22 included a second motor 221 and a second rotating roller 222. The second motor 221 was arranged on one side of one of the two support plates 4. An output end of the second motor 221 penetrated through one of the two support plates 4 and was rotationally connected with one end of the second rotating roller 222. And the other end of the second rotating roller 222 was rotationally connected with the other of the two support plates 4. Through the operation of the first motor 211 and the second motor 221, the first rotating roller 218 and the second rotating roller 222 were respectively driven to rotate, which improves the traction force onto the fabric and prevents the fabric from falling off during the winding process.

Specifically, the conveying component 3 included an unloading assembly 31 and a feeding assembly 32. Two unloading assemblies 31 were provided, and the two unloading assemblies 31 were symmetrically arranged between the two support plates 4. The feeding assembly 32 was arranged on one side of one of the two support plates 4, and the output end of the feeding assembly 32 penetrated through the one of the two support plates 4 and extended between the two support plates 4. Each unloading assembly 31 includes a guide block 311, a first conveying rod 312, and a second conveying rod 313. The first conveying rod 312 and the second conveying rod 313 were staggered on one side of one of the two support plates 4, and an unloading port 314 for unloading was formed between the adjacent ends of the first conveying rod 312 and the second conveying rod 313. The guide block 311 was arranged at the top of the first conveying rod 312. The guide block 311 was to prevent the deviation of the first rotating roller 218 during the downward sliding, which would lead to the failure of unloading.

Specifically, the feeding assembly 32 included a third motor 321, a first rotating rod 322, a third fixed block 323, two first bevel gears 324, two rising members 325 and several fourth fixed blocks 326. The third motor 321 was arranged on one side of one of the two support plates 4, and the output end of the third motor 321 penetrated through the support plates 4 and was fixedly connected with one end of the first rotating rod 322. The third fixed block 323 was horizontally installed between the two support plates 4. Several the fourth fixed blocks 326 were arranged at the bottom of the third fixed block 323 along the length direction of the third fixed block 323 in intervals. The other end of the first rotating rod 322 successively penetrates through several the fourth fixed blocks 326 and was fixedly connected with one of the first bevel gears 324. The other one of the first bevel gears 324 was sheathed on the first rotating rod 322 and was fixedly connected with the first rotating rod 322. The two rising members 325 were symmetrically arranged between the two support plates 4. The two rising members 325 were respectively rotationally matched with the two first bevel gears 324 and supported the first rotating rod 322 through several the fourth fixed blocks 326 installed at the bottom of the third fixed block 323 at intervals.

Specifically, each of the rising member 325 included a support rod 3251, a fifth fixed block 3252, a second bevel gear 3253, a second rotating rod 3254, a first screw 3255, a second screw 3256, a rising rod 3257, a sleeve 3258, and an arc-shaped support block 3259. The bottom of the second rotating rod 3254 penetrated through the third fixed block 323 and was fixedly connected with the second bevel gear 3253. The second bevel gear 3253 was engaged with the first bevel gear 324. The first screw 3255 was arranged on the top of the second rotating rod 3254. The support rod 3251 was arranged on one side of one of the two support plates 4. The fifth fixed block 3252 was arranged on the top side of the support rod 3251. The rising rod 3257 was arranged at the bottom of the fifth fixed block 3252. The two ends of the rising rod 3257 were respectively rotationally connected with the fixed bottom plate 1 and the fifth fixed block 3252. The second screw 3256 and the sleeve 3258 were sheathed on the rising rod 3257 in intervals, and the second screw 3256 and the sleeve 3258 were slidably connected with the rising rod 3257. The second screw 3256 was threaded with the first screw 3255. The arc-shaped support block 3259 was arranged on one side of the support rod 3251. The arc-shaped support block 3259 was fixedly connected with the sleeve 3258. The second screw 3256 was threaded with the first screw 3255, so that when the first screw 3255 rotates, the second screw 3256 was driven to move, and then the sleeve 3258 and the arc-shaped support block 3259 were driven to move, so as to realize the transmission of the first rotating roller 218, which eliminated the process of manual reciprocating transportation and improved the work efficiency.

Specifically, a groove 11 for supporting the first rotating roller 218 was formed between the second conveying rod 313 and the support rod 3251, and the groove 11 was matched with the arc-shaped support block 3259 to limit the first rotating roller 218, so that the arc-shaped support block 3259 could drive the first rotating roller 218 to rise.

The working principle of the production equipment was as follows. When the fabric over the first rotating roller 218 was printed, the air cylinder 212 was ran and drove the first motor 211 to move. Meanwhile, the clamping pillar 215 was pulled, so that the first rotating roller 218 slid down to the unloading port 314 along the length direction of the first conveying rod 312, and then slid onto the second conveying rod 313, and finally fell into the groove 11. At this time, the third motor 321 was driven to work, the first bevel gear 324 was driven to rotate by the first rotating rod 322, the first screw 3255 was driven to rotate by the engagement of the first bevel gear 324 and the second bevel gear 3253. The second screw 3256 and the sleeve 3258 were driven to move upward by the threaded connection of the first screw 3255 and the second screw 3256. The first rotating roller 218 was thereby driven to move upward to the input end of the second conveyor belt 65 through the arc-shaped support block 3259. Therefore, the fabric over the first rotating roller 218 could be continuously subjected to a drying, which eliminated the process of manual reciprocating transportation and improved the work efficiency.

Figure 7:
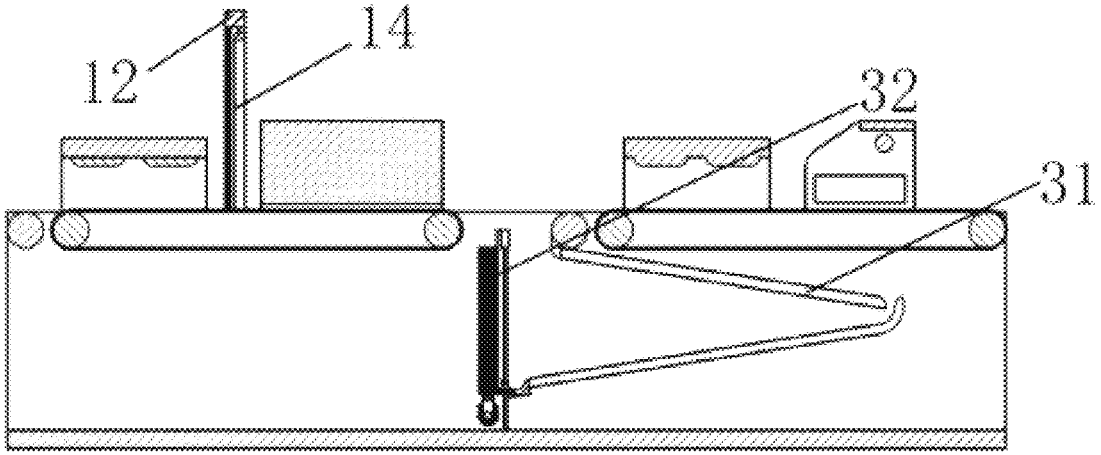
FIG. 7 shows the sectional view of the manufacturing equipment of the present disclosure along an A-A line of FIG. 6.
Figure 8:
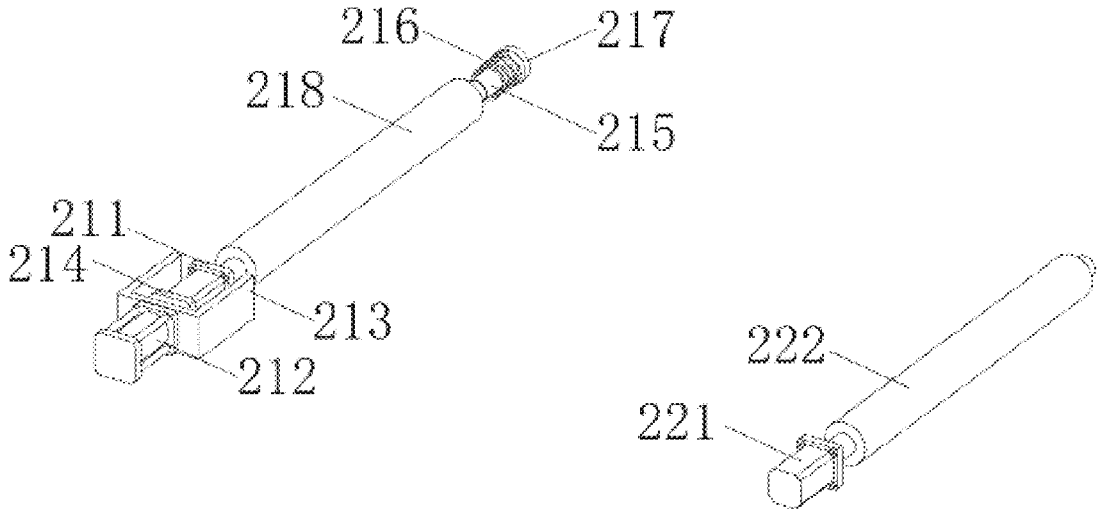
FIG. 8 shows the three-dimensional structure of the clamping traction component of the present disclosure.
Figure 9:
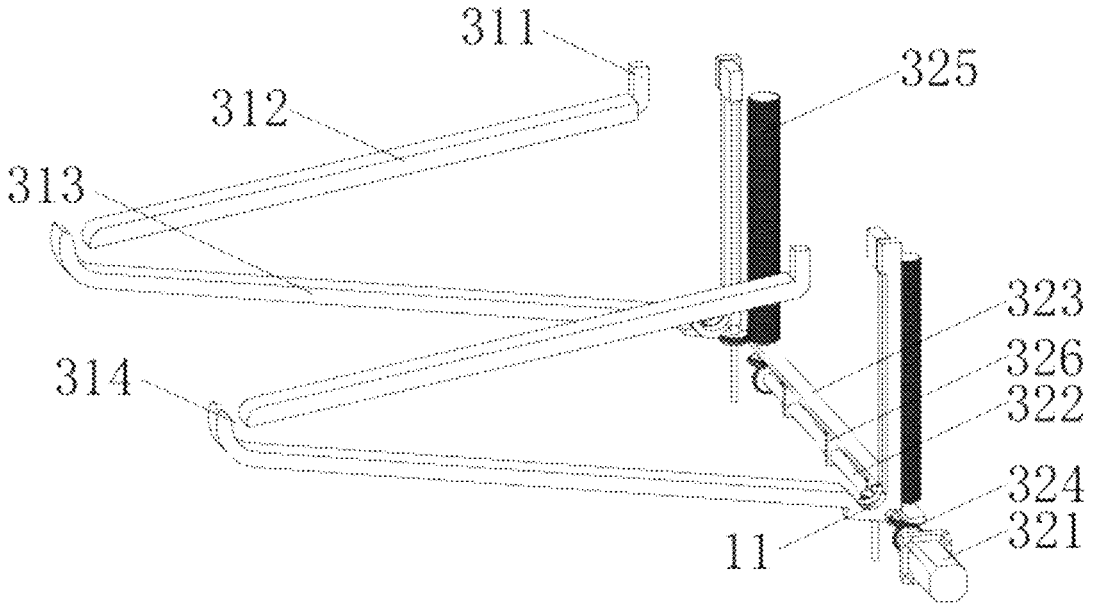
FIG. 9 shows the three-dimensional structure of the conveying component of the present disclosure.
Figure 10:
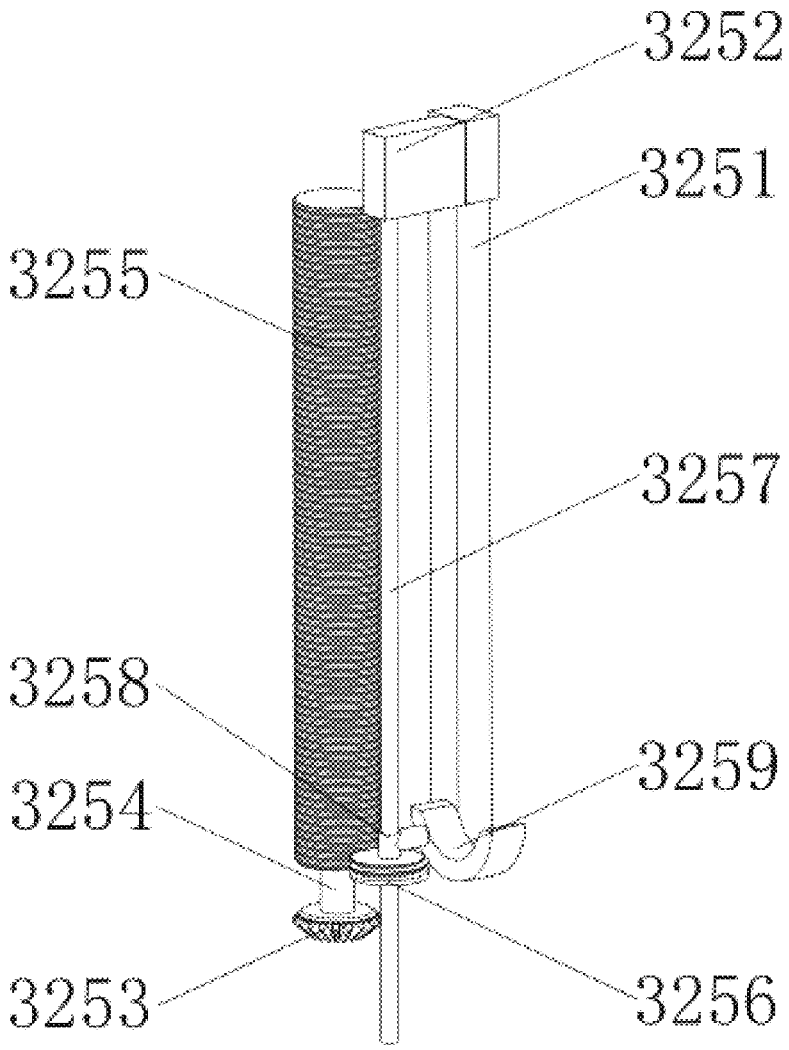
FIG. 10 shows the three-dimensional structure of the ascending member of the present disclosure.
Figure 11:
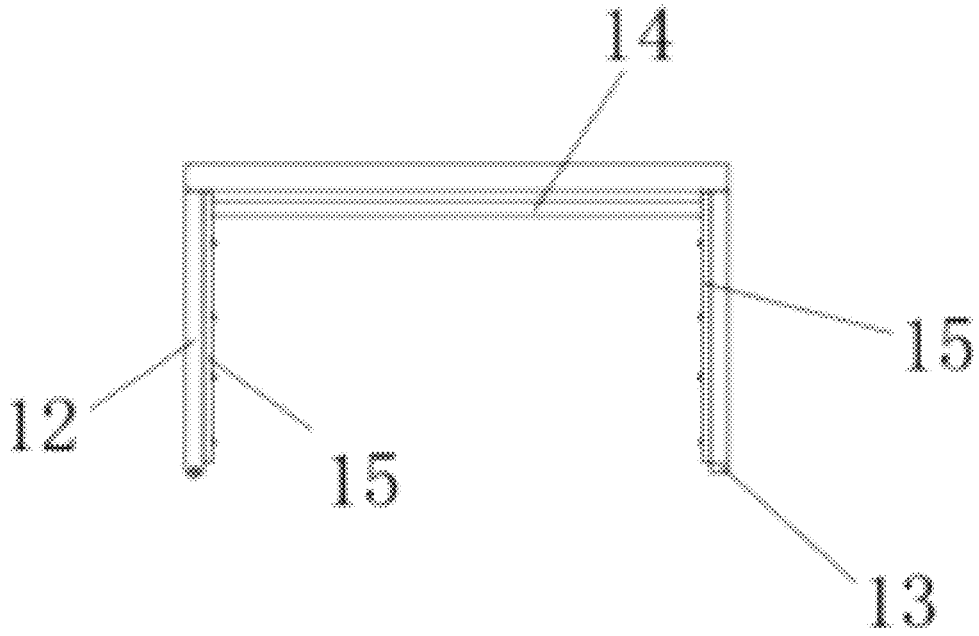
FIG. 11 shows the structure of the U-shaped frame of the ascending member of the present disclosure.

Secondly, as shown in FIG. 3 and FIG. 7, a U-shaped frame 12 was arranged on at an upper side of one of the two support plates 4 through a hinge point, and one end of the U-shaped frame 12 far away from the one of the two support plates 4 was provided with a V-shaped opening 13. The U-shaped frame 12 rotated around the hinge point such that the V-shaped opening 13 is stuck on the uppermost side of the other of the two support plates 4. A rolling curtain 14 positioned between the printing machine 7 and the first dryer 8 was connected to the U-shaped frame 12, and a gap was left between a lower side of the rolling curtain and an upper conveying surface of the first conveyor belt 5 after unwinding the rolling curtain.

The roller curtain 14 could separate the printing zone from the drying zone to avoid heat transferring. Meanwhile, the printing zone was arranged in a first room, and the drying zone was arranged in a second room. The first room was communicated with the second room, and the rolling curtain could close the connected part of the two. In summer, when the air conditioner in the first room was turned on, the designed rolling curtain could be used to save energy consumption of the air conditioner.

In addition, air outlet pipe 15 was respectively arranged at the two vertical ends of the U-shaped frame 12. The upper ends of two air outlet pipes 15 were connected to the air inlet main pipe. The lower end of each outlet pipe 15 was closed. The air outlet holes inclined to the middle of the printing machine 7 was respectively arranged on each outlet pipe 15, and the air outlet holes were used to reduce the subsequent drying time.

The pattern design treatment was performed by utilizing an AI intelligent pattern design platform, for example, MiHui intelligent pattern design platform. That is to say, artificial intelligence technology was used to design the required pattern. Tens of millions of material pictures were stored in the software cloud function. After the required pattern style was input, pictures were generated at the speed of 50 patterns per minute by automatic design of artificial intelligence. Hundreds of pictures could be produced in a few minutes or an hour for customers to choose. According to the opinions of customers, the chosen pictures could be modified by adding the materials and pictures that the customers want and redesigning a new pattern draft through artificial intelligence for the customers to choose. Three-dimensional model sample clothes were generated by using automatic model dressing function in the software. Through the Mini Program function of WeChat, the sample clothes were sent to the customer to confirm the design effect, which eliminated the whole traditional process of sending the small sample to the customers for confirmation, and shortened the development time and design cost. The designed patterns were featured by high definition, wide thinking, strong three-dimensional sense, and many new styles.

AI intelligent pattern design brought about an improvement in design efficiency by 5 times. The popular colors could be controlled by AI intelligent online color matching, and 3D simulation effect could be displayed through one click fitting, and massive gallery were updated continuously by designers and artificial intelligence.

24-head high resolution digital ink-jet printing machine was used as the digital ink-jet printing system, which could automatically control the ink spots. Through the self-designed ICC density curve, the quantity of ink could be effectively controlled, and the pattern output could be obtained basically as what you see on the professional computer display. By using 600 dpi bi-directional high-precision printing mode, the pattern produced had strong three-dimensional sense, rich color, regularly-changed moire, strong artistic sense and was environmentally friendly. Further, the production speed was fast to meet fast fashion production of the market. The digital ink-jet printing was performed by using artificial intelligence design pattern(s), and the patterns were avant-garde and fashionable, deeply loved by consumers, and has strong market competitiveness. Thus, it was the first choice of fabrics for upscale brands to make summer clothing, and has a good development prospect.

The digital ink-jet printing machine adopted an intelligent color management system, which was performed as the following procedures:

a0. Intelligent Color Matching and Proofing

"the pattern could be obtained as what you see". That is to say, the color of the final product was what the remote designer saw on the screen, which improved the efficiency of digital proofing, and shortened the process and cycle of sample confirmation, thereby realizing "the ink-jet printing factory on the designer's desktop".

b0. With Intelligent Control, Unified Colors can be Produced Between Networked Machines Among all the networked machines, colors to be printed were standardized and amount thereof were highly unified, so as to realize flexible production scheduling of one pattern by several machines and collaborative printing production.

c0. Intelligent Color Verification

The ink-jet printed color was regularly and intelligently calibrated, and the data was tracked and compared, and the color difference was quantified and corrected by one click, which was always the same as before. At any time, for any ink-jet printing machine, products for the resubscribed order could be produced without color differences.

The digital ink-jet printing machine also adopted an printing system, which was digital, intelligent, and networked, and the digital ink-jet printing was performed as follows:

a. Digital Output of Pattern

The pattern from the computer was digitally output by the digital ink-jet printing system, and the ink was controllably jetted onto the fabric according to the demand. The combination proportion of the inks was automatically quantified by the computer, and stored in the database automatically.

b. Intelligent Pattern Recognition

Pattern features were recognized intelligently, and color printing modes were recommended automatically to match with the pattern.

c. Intelligently Matching Printing Process

The process parameters for printing pattern were saved automatically. When printing again, the original process parameters could be matched automatically.

d. Intelligent Evaluation of Pattern Ink Consumption

According to color(s) of the pattern and printing process, the ink consumption of each color could be intelligently evaluated, and the ink cost and total ink consumption could be calculated.

e. Intelligent Full Closed Loop Stepping Control

The motion of the guide belt was tracked and detected by magnetic grating, and the compensation was calculated intelligently in real time to ensure the high-precision stepping motion of the guide belt.

f. Intelligent Nozzle Protection

There were four kinds of nozzle protection. The height of the fabric surface and the foreign matter on the surface of guide belt were detected in real time. In case of abnormal conditions, alarm shall be given immediately, and the nozzle shall be suspended or raised to protect the nozzle.

g. Online Intelligent Quality Monitoring

In the process of the ink-jet printing, the machine vision and AI intelligence were used to monitor the quality of ink-jet printing online and give an alarm. If it was determined that the nozzle was short of ink, the nozzle cleaning procedure would be started automatically.

h. Intelligent Ink Temperature-Controlled System

The ink temperature was intelligently and circularly controlled to ensure the stable and continuous printing production of the nozzle under the constant temperature.

i. Remote Assignment of Printing Workflows

The dispatching center collects the RIP of images and remotely assign the workflows to the on-line machines to queue up for automatic printing in sequence according to the operation progress of the on-line jet printing machines. Because the colors for the ink-jet printing of each machine had been standardized and unified, the production operation could be flexibly scheduled, and multi-machine collaborative production could be realized.

j. Remote Operation and Maintenance

The machine running faults were monitored remotely to find out the causes, and the solutions were provided. Or the program version was upgraded remotely. According to the operation time and output, maintenance and consumable replacement reminders were timely issued.

After the ink-jet printing was completed, the fabric was passed into the drying zone. In the drying zone, electric heating drying was used, and the temperature in the drying room was 80-90° C.

After drying, the fabric should be sealed with plastic paper to prevent moisture. The drying zone was separated from the ink-jet printing system, and the glass door was used in the middle to separate into two rooms, namely two different spaces. The water vapor and heat after drying were recovered through the water vapor and waste heat removal channels in the drying zone, which could effectively control the rise in temperature in the ink-jet printing zone, prevent the nozzle blockage, and reduce the air conditioning burden, thereby reducing power consumption and the energy consumption.

After drying, a steaming treatment was performed by using a mist type humidifier, to spray moisture and regain moisture, with a speed of 20 m/min. The humidifying was performed sufficiently and homogeneously. Due to the fine pattern, the printed fabric after regaining moisture was steamed immediately. The steaming was performed with parameters: a ring length of 2.3 m, a temperature of 105° C., a time of 10 min, a speed of 26 m/min, and a steam flow of 900 kg/h.

The water washing treatment was performed by utilizing a continuous rope-shaped water washing machine at a speed of 35 m/min. A padder was rinsed with water from a first cylinder and a second cylinder. The fabric was washed in a third cylinder, a fourth cylinder, a fifth cylinder, and a sixth cylinder, which were configured to contain water with a temperature of 90° C. and a soaping agent with a concentration of 4 g/L. The fabric was washed with water in a seventh cylinder and an eighth cylinder. The fabric was then dehydrated and scutched.

S7. soft setting: the fabric obtained in step S6 was soft set by utilizing a setting machine.

The soft setting was performed by utilizing a Monforts Fong's setting machine. The formula of the softener was as follows: a stiffening finishing agent of 30 g/L and a soft ice-sense finishing agent of 100 g/L.

The soft setting was performed with parameters: a temperature of 160° C., a speed of 40 m/min, an air volume of 1500 r/min, a pressure of 3 kgf/cm$^2$, an overfeed of 15/0/3%, and an unloading width of 142 cm, and a weight of 145 g/m2.

S8. decating treatment: the fabric obtained in step S7 was subjected to a decating treatment. Under a condition of damp heat and relaxation, and a residual internal stress was eliminated. Specifically, the decating treatment was performed with parameters: a speed of 20 meters, and a temperature of 130° C. Through the above process and parameters, the fabric was stable in shape and soft in handle, and the elasticity of the fabric was increased.

S9. pre-shrinking treatment: the fabric obtained in step S8 was subjected to a pre-shrinking treatment by utilizing a pre-shrinking machine, to make a size change rate of water washing not more than 3%, obtaining the fabric with an intelligently-designed digitally-printed pattern.

The pre-shrinking treatment was performed by utilizing an Italy SANTEX pre-shrinking machine, with parameters: a temperature of 135° C., a speed of 28 m/min, a feeding fabric speed ratio of 1%, an unloading blanket speed ratio of 5%, and a cooling belt speed ratio of 1%.

After pre-shrinking, the surface smoothness of the fabric increases, the width was stable and the gloss was enhanced, and the size change rate of water washing was not more than 3%.

In this example, cotton yarn, bamboo fiber yarn, and mulberry silk yarn were blended knitted. Artificial intelligence design pattern was printed by a digital ink-jet printing. The intelligent color management system and printing system were designed to be digital, intelligent and networked, realizing intelligent color matching and proofing, and one button fitting three-dimensional simulation display. The introduction of artificial intelligence pattern design and digital printing keep up with the fashion trend, increasing its artistry. The prepared product was smooth, comfortable, and breathable, felt cool when it contacted the skin, and exhibited natural antibacterial, bacteriostatic and anti-ultraviolet properties. Thus, it was the first choice of fabrics for upscale brands to make summer clothing. Meanwhile, the manufacturing process was energy saving, and realizes the clean production.

TABLE 1

Performance of the silk-cotton plain fabric product with an intelligently-designed digitally-printed pattern

| Performance index | | Test result |
|---|---|---|
| Formaldehyde content/(mg · kg$^{-1}$) | | Not detected |
| pH | | 6.4 |
| Decomposable aromatic amine dyes/(mg · kg$^{-1}$) | | Not detected |
| Bursting strength/N | | 430 |
| Pilling/grade | | 4-5 |
| Twist rate after washing with water/% | | 0.8 |
| Peculiar smell | | None |
| Size change rate of water washing/% | Vertical | +0.2 |
| | Transverse | +1.5 |
| Color fastness to washing/grade | Discoloration | 4.0-5.0 |
| | Staining | 4.0-5.0 |
| Color fastness to perspiration/grade | Discoloration | 4.0-5.0 |
| | Staining | 4.0-5.0 |
| Color fastness to water/grade | Discoloration | 4.0-5.0 |
| | Staining | 4.0-5.0 |
| Color fastness to rubbing/grade | Dry rubbing | 4.0-5.0 |
| | Wet rubbing | 3.0-4.0 |

Figure 4:
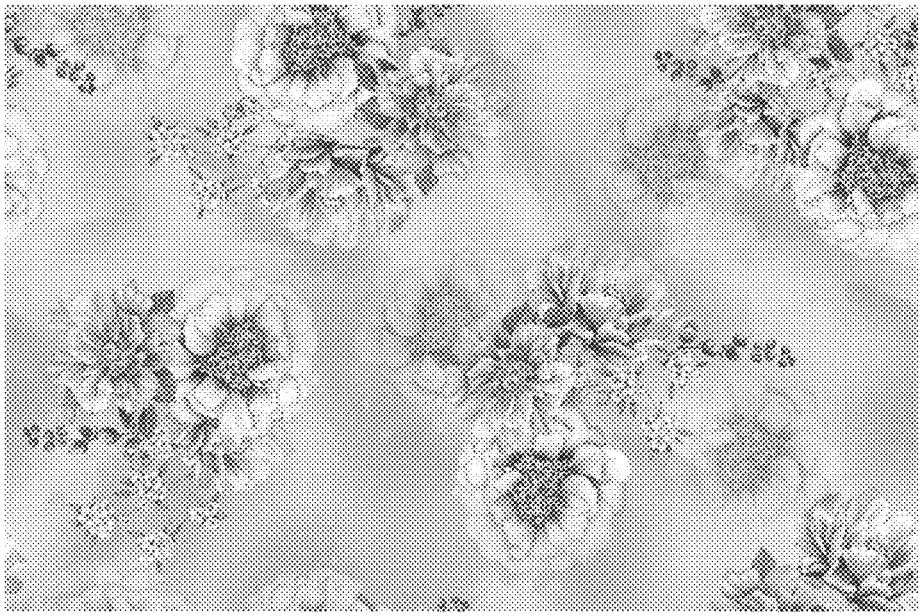
FIG. 4 shows the final product of the silk-cotton plain digital fabric according to the present disclosure.
Figure 5:
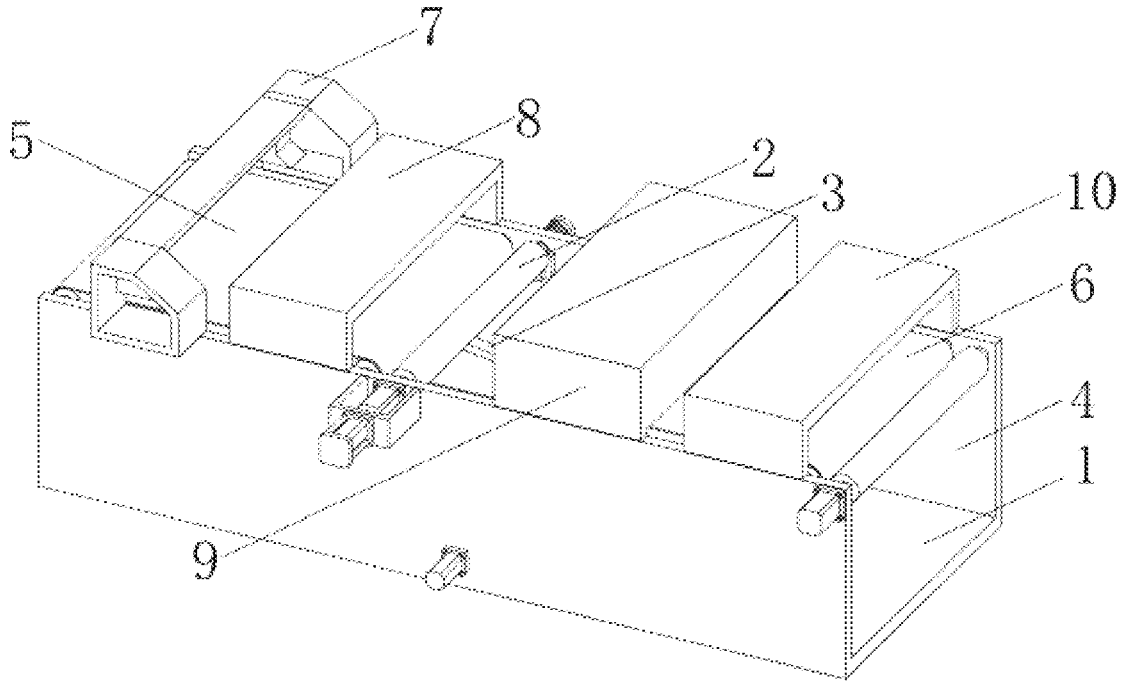
FIG. 5 shows the three-dimensional structure of the manufacturing equipment of the present disclosure.
Figure 6:
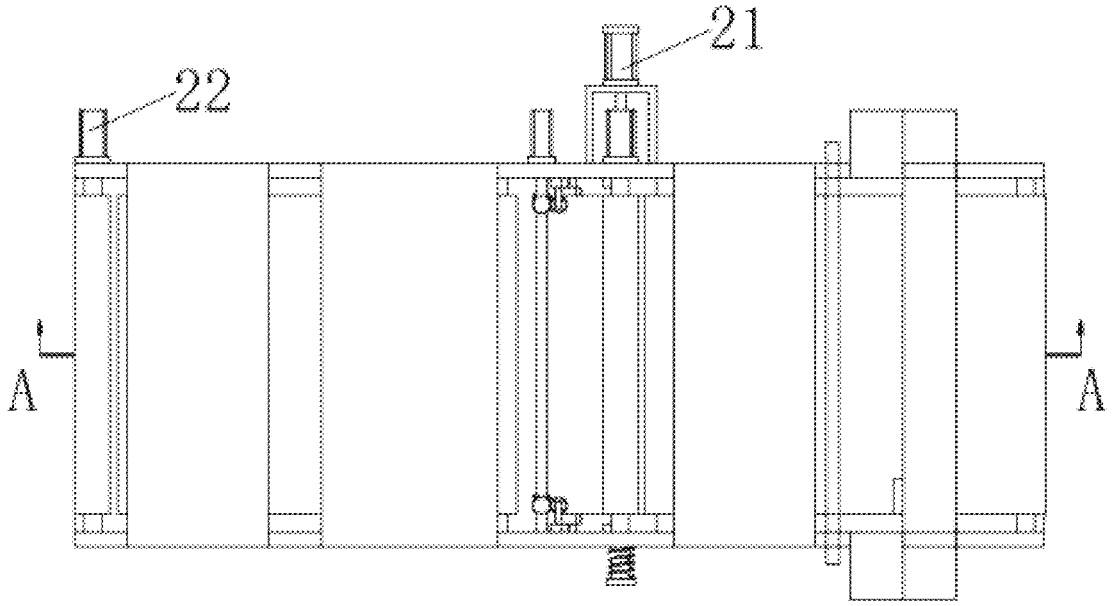
FIG. 6 shows the top view of the manufacturing equipment of the present disclosure.

It can be seen from table 1 and FIG. 4 that the product produced by the above process has avant-garde pattern and is a biomass textile that does not cause damage to health and is environmentally friendly. All technical indexes meet the requirements of GB/T 22848-2009 "Finished Knitted Fabrics". The product has exquisite pattern, stable size, bright luster, soft texture, advantage of not easy to pilling, and good color fastness, thereby being an excellent green fashion digital fabric.

Example 2

This example was performed with structure and principle basically the same as that of Example 1, except that the neutralizing treatment was performed by using 0.4 g/L oxalic acid.

Example 3

This example was performed with structure and principle basically the same as that of Example 1, except that the fabric was subjected to a singeing with a burner pressure of 1.5 Pa and a singeing speed of 56 m/min, or a burner pressure of 1.7 Pa and a singeing speed of 54 m/min.

Example 4

This example was performed with structure and principle basically the same as that of Example 1, except that the mercerizing is performed with parameters: an alkali resistant penetrating agent 1005 with a concentration of 7.8 g/L, and a roll alkali with a concentration of 187 g/L, or an alkali resistant penetrating agent 1005 with a concentration of 8.3 g/L, and a roll alkali with a concentration of 183 g/L.

Example 5

This example was performed with structure and principle basically the same as that of Example 1, except that the bleaching is performed with a bleach, which consisted of hydrogen peroxide with a concentration of 7.8 g/L and a hydrogen peroxide stabilizer with a concentration of 0.6 g/L, or hydrogen peroxide with a concentration of 8.3 g/L and a hydrogen peroxide stabilizer with a concentration of 0.4 g/L.

Example 6

This example was performed with structure and principle basically the same as that of Example 1, except that the sizing agent consisted of 490 g of a self-preparation chemical synthesis paste and 340 g of water, or 510 g of a self-preparation chemical synthesis paste and 320 g of water.

The specific embodiments described above are only intended to illustrate the spirit of the present disclosure. A person skilled in the art to which the present disclosure belongs may make various modifications or supplements to the described specific embodiments or use similar substitutions, but they does not deviate from the spirit of the present disclosure or go beyond the scope defined in the appended claims.

What is claimed is:

1. A method for manufacturing a fabric with an intelligently-designed digitally-printed pattern with energy saving effect, comprising S1: knitting a cotton yarn, a bamboo fiber yarn, and a mulberry silk yarn into a silk-cotton plain knitted single-sided fabric;

S2: subjecting the silk-cotton plain knitted single-sided fabric to a double-sided singeing to obtain a fabric after the singeing;

S3: mercerizing the fabric after the singeing by utilizing a knitting mercerizing machine to obtain a mercerized fabric;

S4: subjecting the mercerized fabric to a neutralizing processing, a bleaching processing, a deoxidating processing, and a whitening processing in sequence to obtain a boiled-out fabric;

S5: setting the base color of the boiled-out fabric to obtain a colored fabric;

S6: subjecting the colored fabric to a sizing and setting treatment, a pattern design treatment, a digital printing, a steaming treatment, and a water washing treatment to obtain a printed fabric, wherein the digital printing is performed by performing an ink-jet printing on a fabric obtained from the pattern design treatment by a digital ink-jet printing system of a digital printing and drying partition processing apparatus to obtain an ink-jet printed fabric; and after the ink-jet printing, passing the ink-jet printed fabric into a drying zone and drying therein;

S7: subjecting the printed fabric to a soft setting by utilizing a setting machine to obtain a soft set fabric;

S8: subjecting the soft set fabric to a decating treatment under a condition of damp heat and relaxation, to eliminate a residual internal stress, to obtain a fabric after the decating treatment; and S9: pre-shrinking the fabric after the decating treatment by utilizing a pre-shrinking machine to make a size change rate of water washing not more than 3%, to obtain the fabric with an intelligently-designed digitally-printed pattern.

2. The method of claim 1, wherein in step S1, the cotton is a long staple cotton; 46% of 65S long staple cotton yarn, 42% of the bamboo fiber yarn, and 12% of the mulberry silk yarn are combined to form the double strand yarn.

3. The method of claim 1, wherein in step S2, the singeing is performed with parameters: a burner pressure of 1.5-1.7 Pa and a singeing speed of 54-56 m/min, and the singeing should be uniform to prevent uneven singeing.

4. The method of claim 1, wherein in step S3, the mercerizing is performed with parameters: an alkali resistant penetrating agent of 7.8-8.3 g/L, a roll alkali concentration of 183-187 g/L, a speed of 18 m/min, an unloading weight of 135 g, an overfeed of 12/0/0%, and an unloading width of 140 cm.

5. The method of claim 1, wherein in step S4, the neutralizing processing is performed by using an oxalic acid;

the bleaching processing comprises step A: feeding a hot water with a temperature of 40° C., adding a hydrogen peroxide stabilizer and an iron ion chelating dispersant and operating for 2 minutes, adding an alkali and operating for 2 minutes, and adding hydrogen peroxide and operating for 2 minutes;

step B: heating to 70° C., and adding a refining agent;

step C: heating to 98° C., maintaining the temperature for 40 minutes, then cooling to 78° C. and cutting a sample, finally heating to 80° C. and washing by overflowing water for 10 minutes, measuring a pH value of a drainage at an outlet, and draining and discharging the fabric;

the deoxidating processing comprises using a high-efficiency deoxyenzyme with a temperature of 45° C.;

the whitening processing comprises feeding the fabric into water, adding an acid, heating to 40° C., adding 0.6% of a whitening agent and 0.1% of a fluorescent whitening agent, heating to 90° C., operating for 20 minutes, whitening a base fabric, cooling to 78° C. and cutting a sample, feeding water, washing by overflowing water for 5 minutes, and draining and discharging the fabric; and the bleaching processing is performed with a bleach; the bleach comprises hydrogen peroxide with a concentration of 7.8-8.3 g/L, a refining agent with a concentration of 1 g/L, caustic soda with a concentration of 2.5 g/L, a hydrogen peroxide stabilizer with a concentration of 0.4-0.6 g/L, and an iron ion chelating dispersant with a concentration of 1.2 g/L.

6. The method of claim 1, wherein in step S5, the setting is performed with parameters: a temperature of 140° C., a rate of 50 m/min, an air volume of 1500 r/min, a pressure of 5 kgf/cm$^2$, an overfeed of 8/0/0%, a width of 153 cm, and a weight unit area of 140 g/m2.

7. The method of claim 1, wherein in step S6, the sizing and setting treatment is performed by an impregnation to make the fabric be coated with a sizing agent, and the sizing agent comprises, in parts by weight, 490-510 g of a self-preparation chemical synthesis paste, 30 g of sodium bicarbonate, 10 g of a colorless anti-staining, 30 g of sodium sulfate, 70 g of urea, 30 g of hygroscopic agent, and 320-340 g of water;

the impregnation is performed with parameters: a rolling pressure determination of 3 kgf/cm$^2$, an air volume of 1260 r/min, a temperature of 110° C., a speed of 40 m/min, a pick-up rate of 85%, and an overfeeding of 0/0/0%;

the pattern design treatment is performed by utilizing an AI intelligent pattern design platform;

the steaming treatment is performed by utilizing a mist type humidifier to spray moisture and regain moisture at a speed of 20 m/min, to humidify sufficiently and homogeneously; due to the fine pattern, the printed fabric needs to be steamed immediately after regaining moisture; the steaming is performed with parameters: a ring length of 2.3 m, a temperature of 105° C., a time of 10 minutes, a speed of 26 m/min, and a steam flow of 900 kg/h;

the water washing treatment is performed with a continuous rope-shaped water washing machine having a speed of 35 m/min, and comprises procedures of rinsing a padder with water in a first cylinder and a second cylinder; washing in a third cylinder, a fourth cylinder, a fifth cylinder and a sixth cylinder, which are configured to contain water with a temperature of 90° C. and a soaping agent with a concentration of 4 g/L; cleaning with water in a seventh cylinder and an eighth cylinder; dehydrating and scutching.

8. The method of claim 1, wherein in step S8, the decating is performed at a speed of 20 meters and a temperature of 130° C.

* * * * *